US005717445A

United States Patent [19]

Kida et al.

[11] Patent Number: 5,717,445

[45] Date of Patent: Feb. 10, 1998

[54] IMPROVED RECOVERY MECHANISM AND INK JET APPARATUS PROVIDED WITH SUCH MECHANISM

[75] Inventors: Akira Kida, Yokohama; Soichi Hiramatsu, Hachioji; Hideki Yamaguchi; Hiroyuki Inoue, both of Yokohama; Takashi Nojima, Mitaka; Hitoshi Nakamura, Kawasaki; Hideaki Kawakami; Takeshi Iwasaki, both of Yokohama, all of Japan

[73] Assignee: Canon Kabushiki Kaisha, Tokyo, Japan

[21] Appl. No.: 492,418

[22] Filed: Jun. 19, 1995

[30] Foreign Application Priority Data

Jun. 24, 1994 [JP] Japan ..... 6-143189

[51] Int. Cl.[6] ..... B41J 2/05

[52] U.S. Cl. ..... 347/33

[58] Field of Search ..... 347/22, 23, 24, 347/33, 34, 35, 36

[56] References Cited

U.S. PATENT DOCUMENTS 4,340,897 7/1982 Miller ..... 346/140 R
4,959,673 9/1990 Noda ..... 346/140 R
5,126,765 6/1992 Nakamura ..... 346/140 R

FOREIGN PATENT DOCUMENTS 58-025966 2/1983 Japan .
62-101448 5/1987 Japan .
62-103147 5/1987 Japan .

*Primary Examiner*—Aditya Krishnan
*Attorney, Agent, or Firm*—Fitzpatrick, Cella, Harper & Scinto

[57] ABSTRACT

A recovery mechanism is provided with an elastic blade for wiping the formation surface of ink discharge ports of a recording head by allowing the leading end of its wiping surface to slide on the formation surface of ink discharge ports of the head, and an ink jet recording apparatus is provided with such recovery mechanism. For this recovery mechanism, a guide wall unit, which is extended to the vicinity of the formation surface of ink discharge ports, is arranged along the wiping surface of the blade in a state that the blade is in a wiping operation, and then, ink adhering to the leading end of the wiping surface of the blade is guided to a gap between the guide wall unit and the blade. In this way, the flying splash of ink at the time of wiping can be suppressed for the assurance of a stabilized wiping operation, thus making it possible for the recovery mechanism and the ink jet apparatus provided therewith to perform a high-quality recording.

13 Claims, 6 Drawing Sheets

IMPROVED RECOVERY MECHANISM AND INK JET APPARATUS PROVIDED WITH SUCH MECHANISM

BACKGROUND OF THE INVENTION

1. Field of the Invention

The present invention relates to an improved recovery mechanism provided with a cleaning member for removing the dew condensation and wet ink occurring on the formation surface of ink discharge ports of a recording head which performs recording by discharging ink, and to an ink jet apparatus provided with such mechanism.

2. Related Background Art

A recording apparatus having the function of a printer, copying machine, facsimile apparatus, or the like, or a recording apparatus used as an output equipment for a complex electronic equipment or a work station including a computer, word processor, or the like, is structured to record images on a sheet, plastic thin plate, or other recording material in accordance with image information.

Such recording apparatuses are divided into those of an ink jet type, a wire-dot type, a thermal type, a laser beam type, or some others in accordance with its recording methods. Of these types, an ink jet recording apparatus is such as to discharge ink from recording means (a recording head) to a recording material. For an apparatus of the kind, it is possible to easily make recording means compactly; to record highly precise images at high speeds; and also, to record images on an ordinary sheet produced without any particular treatments. With these features, its running cost becomes lower. Being non-impact, the ink jet recording apparatus makes less noises in operation. It is also capable of recording color images with ease using ink of many colors, among other advantages.

For example, a recording head of an ink jet type, which utilizes thermal energy for discharging ink, can be fabricated easily with highly densified discharge ports and liquid paths arranged therefor; thus enabling the provision of a head which is produced more compactly.

Now, in an ink jet recording apparatus of the kind, the atmosphere surrounding the recording head presents a high temperature, while in operation, because of the evaporation of water contained in ink and in the recording material as well. Also, depending on conditions such as the head itself, the atmosphere surrounding it, and the temperatures, dew condensation may take place on the formation surface of ink discharge ports (hereinafter referred to as ink discharge surface) of the recording head. Also, ink splashing occurs when discharged ink is impacted on the recording material, causing fine ink droplets other than those discharged from the discharge ports, its satellites, or the like, to adhere to the discharge surface in some cases. Then, if dew condensation or wet ink occurs on the ink discharge surface, it leads to a condition where water droplets and others adhere to it unevenly. These adhering water droplets and others affect the discharged ink when it is discharged from the discharge ports, and cause the discharging direction of ink, the discharging speed, or the diameter of ink droplet in some cases, to vary with the resultant degradation of recording quality. Also, due to the wet ink on the discharge surface, paper particles and others are caused to adhere thereto, producing adverse effects on the discharging direction of ink or the like, or clogging the discharge ports to bring about the degradation of recording quality.

Now, in order to solve the problems described above, there has been proposed a method of wiping the ink discharge surface by use of a rubber blade as a method to clean this surface for the removal of dew condensation, wet ink, or the like. FIG. 6 and FIG. 7 are views which illustrate one example of such method. In FIG. 6 and FIG. 7, a reference numeral 11 designates a rubber blade; 12, a holder which fixes the blade; 3, a recording head; and 3A, the ink discharge surface of the head. The blade 11 is held by the holder 12. Its holding position is set at a given position in the scanning region of the recording head-as shown in FIG. 6. Then, the structure is arranged so that along the scanning of the recording head 3 as indicated by arrows, the leading end 11A of the blade 11 scrapes off foreign particles from the ink discharge surface 3A while keeping it in contact with the ink discharge surface 3A.

However, the conventional example described above still has the problems unsolved as given below. In other words, the moment the leading end 11A of the blade leaves the ink discharge surface 3A of the head, the blade 11 itself is restored by elasticity to the original shape from the state that it is being curved. However, on that moment, ink adhering to the leading end 11A of the blade is caused to part and fly away from the leading end 11A of the blade (hereinafter this condition is referred to as flying splash) by the restoring force exerted on the blade 11. At this juncture, if a recording material resides in the direction of the flying splash of ink, and is still in the recording region when the wiping (cleaning operation) is conducted, such splashed ink adheres to the recording material, causing the degradation of recording quality. Also, if a large amount of ink remains fixedly on the leading end 11A of the blade, it causes to reduce the cleaning capability of the blade, and disable it to execute the head cleaning function properly.

For the purpose of minimizing the influence of the flying splash of ink resulting from the restoring force of a blade of the kind, there has been proposed a structure in Japanese Patent Laid-Open Application No. 62-101448 and Japanese Patent Laid-Open Application No. 62-103147 wherein a slit is provided on the leading end of a blade to weaken its rotational moment in anticipation of the reduction of flying splash of ink the moment the blade leaves the ink discharge surface after having executed a cleaning.

However, the expected contacting force of the blade whose leading end is divided by slits tends to be weakened when it abuts upon the ink discharge surface, and conceivably, it becomes difficult to execute a cleaning sufficiently in a good condition. Also, with the divided blade, it is difficult to allow the entire discharge surface to be in contact with the blade uniformly; thus conceivably, difference occurs in cleaning condition of the ink discharge surface after all.

If it is impossible to achieve a uniform condition of cleaning on an ink discharge surface as described above, the resultant state of ink adhesion to the discharge surface differs, and there is definitely a possibility that a localized degradation of discharging condition is invited earlier than expected.

SUMMARY OF THE INVENTION

With attention to and a view to solving the problems encountered in the conventional art described above, it is an object of the present invention to provide an improved recovery mechanism capable of suppressing the flying splash of ink at the time of cleaning, assuring a stabilized cleaning operation, and executing a high-quality recording, and also, to provide an ink jet apparatus having such improved recovery mechanism in it.

It is another object of the present invention to provide a recovery mechanism having an elastic blade for wiping the formation surface of ink discharge ports of a recording head by enabling the leading end of the wiping surface of the blade to slide on the formation surface of ink discharge ports, wherein a guide wall unit is provided extendedly near the formation surface of ink discharge ports along the wiping surface of the blade in a state that the blade is in a wiping operation, and then, it is arranged to guide the ink, which adheres by the wiping operation to the leading end of the cleaning surface of the blade, to the gap between the guide wall unit and the blade.

It is still another object of the invention to provide an ink jet apparatus having an elastic blade for wiping the formation surface of ink discharge ports of the recording head by enabling the leading end of the wiping surface of the blade to slide on the formation surface of ink discharge ports, wherein a guide wall unit is provided extendedly near the formation surface of ink discharge ports along the wiping surface of the blade in a state that the blade is in a wiping operation, and then, it is arranged to guide the ink, which adheres by the wiping operation to the leading end of the cleaning surface of the blade, to the gap between the guide wall unit and the blade.

In accordance with the present invention, when the formation surface of ink discharge ports is wiped by the leading end of the wiping surface of a blade, the ink thus wiped adheres to the leading end of the wiping surface thereof and held thereon, but it is being guided to the gap formed between the wiping surface of the blade and the guide wall unit extendedly arranged near the formation surface of ink discharge ports of the recording head along the wiping surface of the blade. Thus, the gap between them functions as a capillary to guide the aforesaid ink to the ink retainer. Also, being extendedly provided, the guide wall unit can suppress the rebounding of the leading end of the wiping surface of the blade when it is released from the formation surface of ink discharge ports. In this way, by the application of both functions, it is possible to prevent the flying splash of ink. Also, the leading end of the blade can be in contact with the discharge port surface uniformly. Therefore, it is possible to avoid uneven cleaning, thus achieving the cleaning sufficiently in a good condition.

DETAILED DESCRIPTION OF THE PREFERRED EMBODIMENTS

Hereinafter, with reference to the accompanying drawings, the detailed description will be made of the embodiments in accordance with the present invention.

Figure 1:
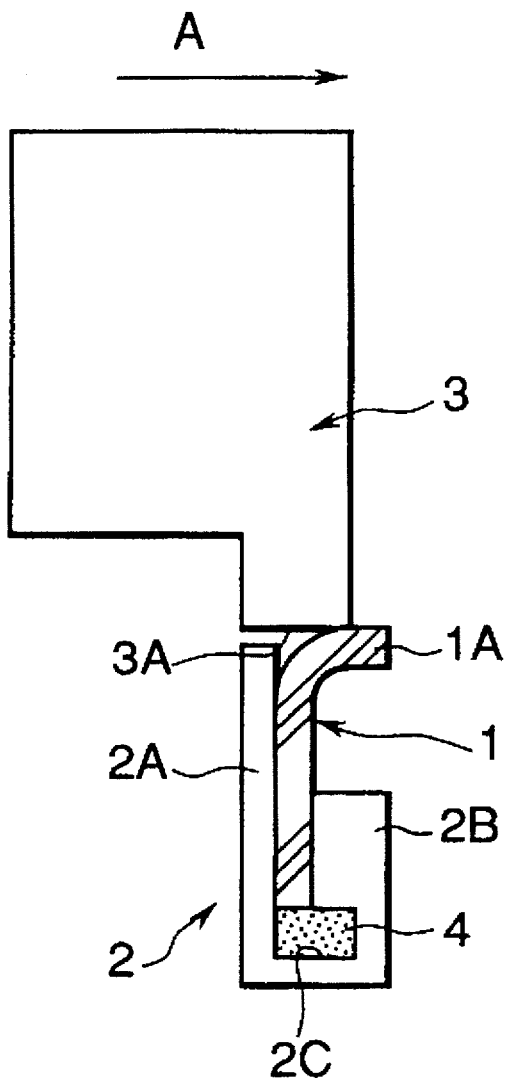
FIG. 1 is a view which illustrates the structure of a wiping mechanism in its wiping operation in accordance with a first embodiment of the present invention.

FIG. 1 shows a first embodiment of the present invention. Here, the features and advantages of the invention are best represented in this embodiment. In FIG. 1, a reference numeral 1 designates an elastic element such as rubber or, more preferably, a blade formed by a porous elastic element capable of absorbing ink; 1A, the leading end of the blade for wiping the ink discharge surface 3A of a recording head 3 while being allowed to slide on the discharge surface 3A; 2, a holder for the blade 1. In accordance with the present invention, the holder 2 is formed to present a section having substantially an L-letter shape as shown in FIG. 1. Here, in the case of the present invention, the wiping operation (an operation to wipe and clean) by means of the blade 1 is executed only when the recording head 3 scans in the direction A indicated by an arrow in FIG. 1. Then, the structure is arranged to allow the blade 1 to retract from the wiping position together with the holder 2 by a known means (not shown) when the head scans in the direction opposite to the direction A.

A reference numeral 2A designates a guide wall unit provided for the holder 2, which functions to guide ink to the base of the blade while suppressing the flying splash of ink, and arranged to keep a slight gap between the leading end of the guide wall unit 2A and the ink discharge surface 3A of the recording head 3 in a wiping state as shown in FIG. 1; 2B, a blade holder which pinches the blade 1 with the guide wall unit 2A for holding it; 2C, an ink retainer formed at the bottom of the holder 2; and 4, an ink absorbent filled in the ink retainer 2C.

With a wiping mechanism (wiping and cleaning mechanism) structured as described above, the leading end 1A of the blade is bent along the ink discharge surface 3A of the recording head 3 when the recording head 3 scans in the direction A so that, as shown in FIG. 1, the ink discharge surface 3A is wiped by the leading end 1A of the blade. Thus the ink, which is transferred from the ink discharge surface 3A by means of the leading end 1A of the blade, is guided from the leading end 1A of the blade to the base (ink retainer) thereof through the gap between the blade 1 and the guide wall unit 2A of the holder. In this respect, if the blade 1 itself is formed by a porous elastic element, ink is also carried to the ink absorbent 4 through the blade, and kept in the ink absorbent 4.

As described above, utilizing the gap to be formed between the guide wall unit 2A and the blade 1, the ink which is wiped off by the leading end 1A of the blade is guided to the absorbent 4 immediately by the cooperative functions of the guide wall and blade. Thus, by absorbing ink in the absorbent, it is possible to prevent ink from residing at the leading end 1A of the blade when it is wiped off by the leading end 1A of the blade. In this way, the amount of flying splash of ink can be reduced, and at the same time, the remaining ink is prevented from being solidified and fixed to the leading end of the blade; hence controlling not to degrade the wiping capability. Also, by arranging the guide wall unit 2A extendedly near the ink discharge surface 3A of the recording head 3, it is possible to suppress the rebounding amount of the leading end 1A of the blade 1 when it is released from the ink discharge surface 3A. In this respect, it is not necessarily structure the guide wall unit 2A integrally with the holder 2. The guide wall unit 2A may be formed itself by a material which can absorb ink. Here, also, with the structure arranged as above, it is possible for the leading end of the blade to clean the ink discharge surface uniformly. Therefore, it is possible to carry out a cleaning in a good condition.

Figure 2:
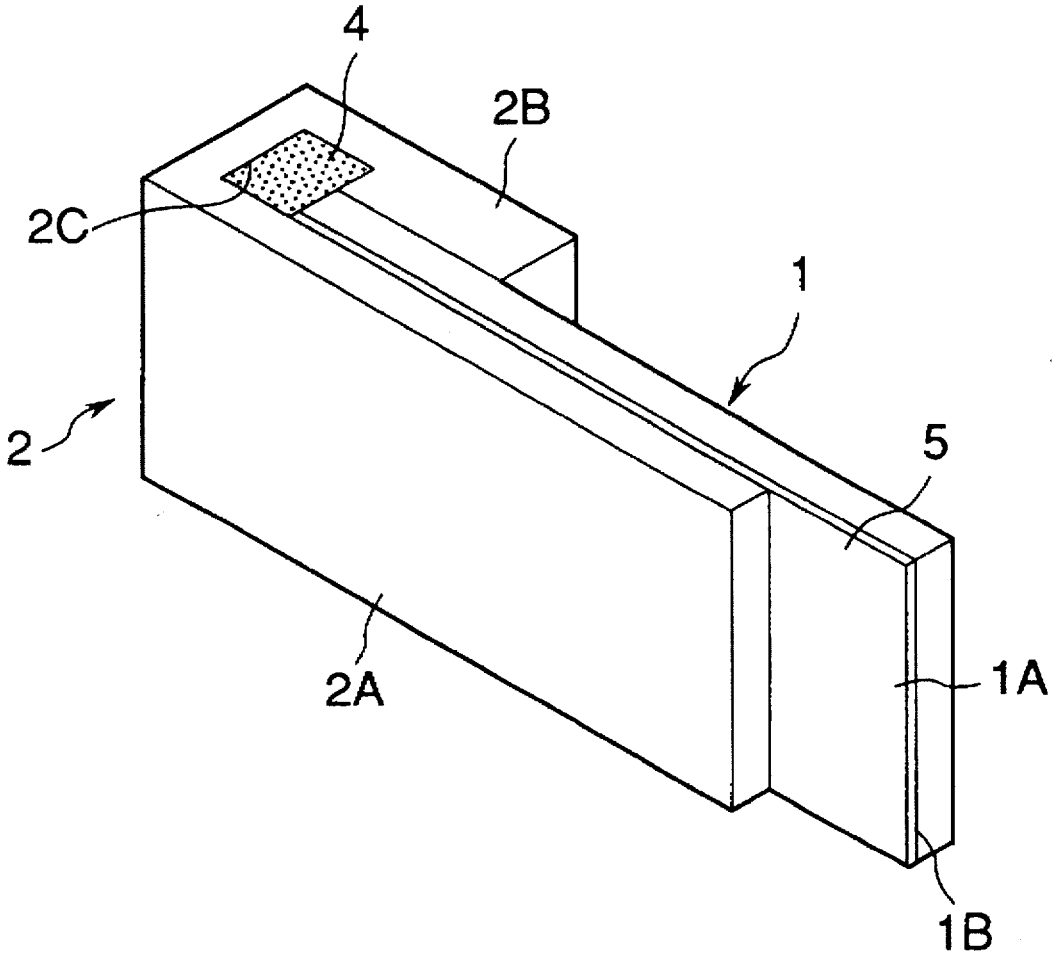
FIG. 2 is a perspective view which shows the structure of a wiping mechanism in accordance with a second embodiment of the present invention.

FIG. 2 shows a second embodiment in accordance with the present invention. The present embodiment is such that a water repellent layer 5 is arranged on the blade surface 1B of the holder 2 on the side which is in contact with the guide wall unit 2A. With the provision of the water repellent layer 5 on the blade surface (wiping surface) 1B of the blade 1 on the side which abuts upon the ink discharge surface 3A, it is possible to guide the ink, which is wiped off when the ink discharge surface 3A is wiped by the leading end 1A of the blade, to the gap between the guide wall unit 2A and the blade along the wiping surface provided with the water repellent layer 5 (hereinafter referred to as a repellent surface) without allowing ink to be permeated into the blade 1 itself, and then, guide it to the ink absorbent 4 along the guide wall unit 2A.

In this respect, the water repellent layer 5 is arranged to cover the entire wiping surface 1B according to the embodiment described above, but it is not necessarily arranged to cover the entire surface. For example, it may be possible to provide the water repellent layer 5 to cover only the portion of the leading end 1A of the blade which is slidably in contact with the ink discharge surface 3A or the region from such portion to the part where the blade 1 is in contact with the guide wall unit 2A. If only a water repellent layer 5 is provided at least for a part of the passage for storage of the ink which is received by a blade 1 of the kind, it is possible to anticipate an effect accordingly.

Figure 3:
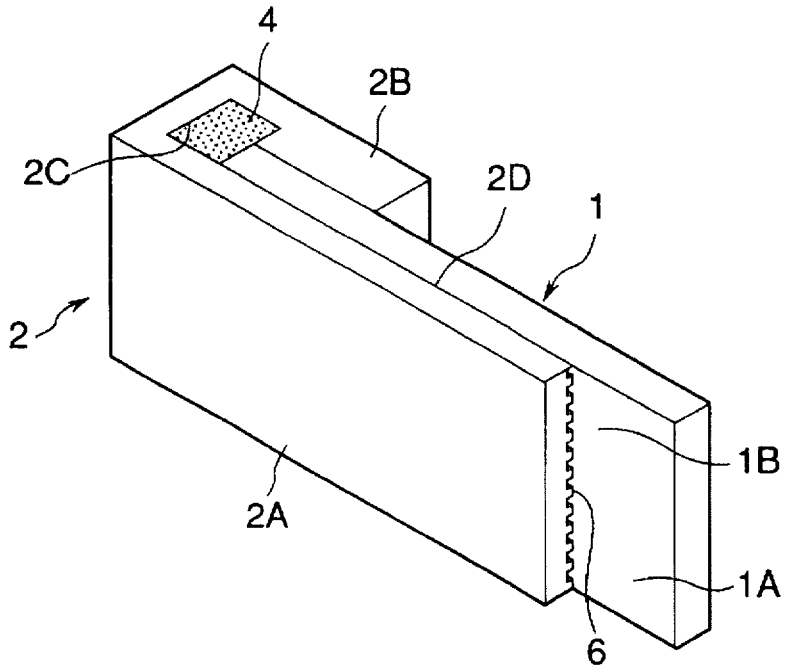
FIG. 3 is a perspective view which shows the structure of a wiping mechanism in accordance with a third embodiment of the present invention.

FIG. 3 shows a third embodiment in accordance with the present invention. The present embodiment is such that fine grooves 6 are arranged on the end of the wall unit 2A extendedly toward the ink retainer 2C along the surface (referred to as an ink induction surface) 2D on the guide wall unit 2A of the holder 2 on the side which is in contact with the blade 1. It is preferable to arrange such fine grooves 6 on the entire width of the ink induction surface 2D. In this way, it is possible to efficiently guide the ink, which is wiped off by the leading end 1A of the blade, to the ink retainer 2C or the ink absorbent 4 filled in the ink retainer 2C along the fine grooves 6 by utilization of its capillary function.

In this respect, it may be possible to provide the fine grooves 6 as in the third embodiment while making the wiping surface 1B a repellent surface as in the second embodiment so as to guide ink toward the ink retainer 2C synergistically.

Figure 4:
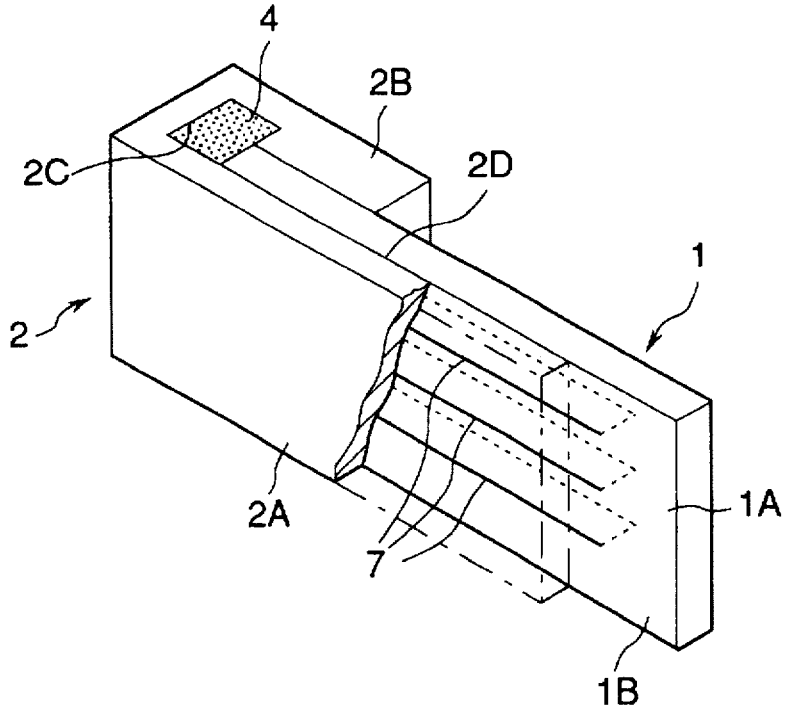
FIG. 4 is a perspective view which shows the structure of a wiping mechanism in accordance with a fourth embodiment of the present invention.

FIG. 4 shows a fourth embodiment in accordance with the present invention. The present embodiment is such that the blade 1 is provided with cut-off grooves 7 to make it easy to guide the ink, which is wiped off by the leading end 1A of the blade 1, to the ink retainer 2C of the holder 2. In this respect, such cut-off grooves 7 are formed extendedly from a location slightly away from the leading end of the blade, and the cut ends of the grooves are present at least on the wiping surface 1B on the guide wall unit 2A side. The depth of the cut-off grooves 7 is equal to the thickness of the blade 1. Therefore, the depth can be such as penetrating the blade 1 from the surface 1B side to its opposite side. Also, the cut-off grooves 7 in the direction along the guide wall unit 2A may be as long as to reach the ink retainer 2C of the holder 2, but it should be good enough if only the grooves are extend at least to the ink retainer 2C side from the blade holding unit 2B.

In accordance with the present embodiment, it is possible to guide the ink, which is wiped off by the leading end 1A of the blade, to the ink retainer 2C of the holder 2 through the cut-off grooves 7 formed on the blade 1 itself. In this respect, the present embodiment can be combined with the third embodiment or the second embodiment to provide a structure.

In each of the embodiments described above, no description has been made of any relative positions between the recording head 3 and the wiping mechanism, but it is possible to apply the present invention widely to an ink jet recording apparatus which is provided with a wiping mechanism, such as an ink jet recording apparatus which performs recording in a mode that the ink discharge surface 3A of the recording head 3 is arranged downwardly, while a recording material is held horizontally for recording or an ink jet recording apparatus which performs recording in a mode that a recording material is held almost vertically or in an inclined direction, and ink is discharged from the ink discharge surface 3A which is positioned relatively to allow it to face the recording material for recording.

Also, the ink retainer 2C arranged for the holder 2 can be formed in any shape as far as it is structured to retain ink temporarily without any ink leakage around it. Further, in each of the embodiments described above, an ink absorbent 4 is filled in the ink retainer 2C as a preferred mode. It may be possible to provide the ink retainer 2C alone for the holder 2 or it may also be possible to install an exhaust tube on the ink retainer 2C to exhaust ink therefrom.

Figure 5:
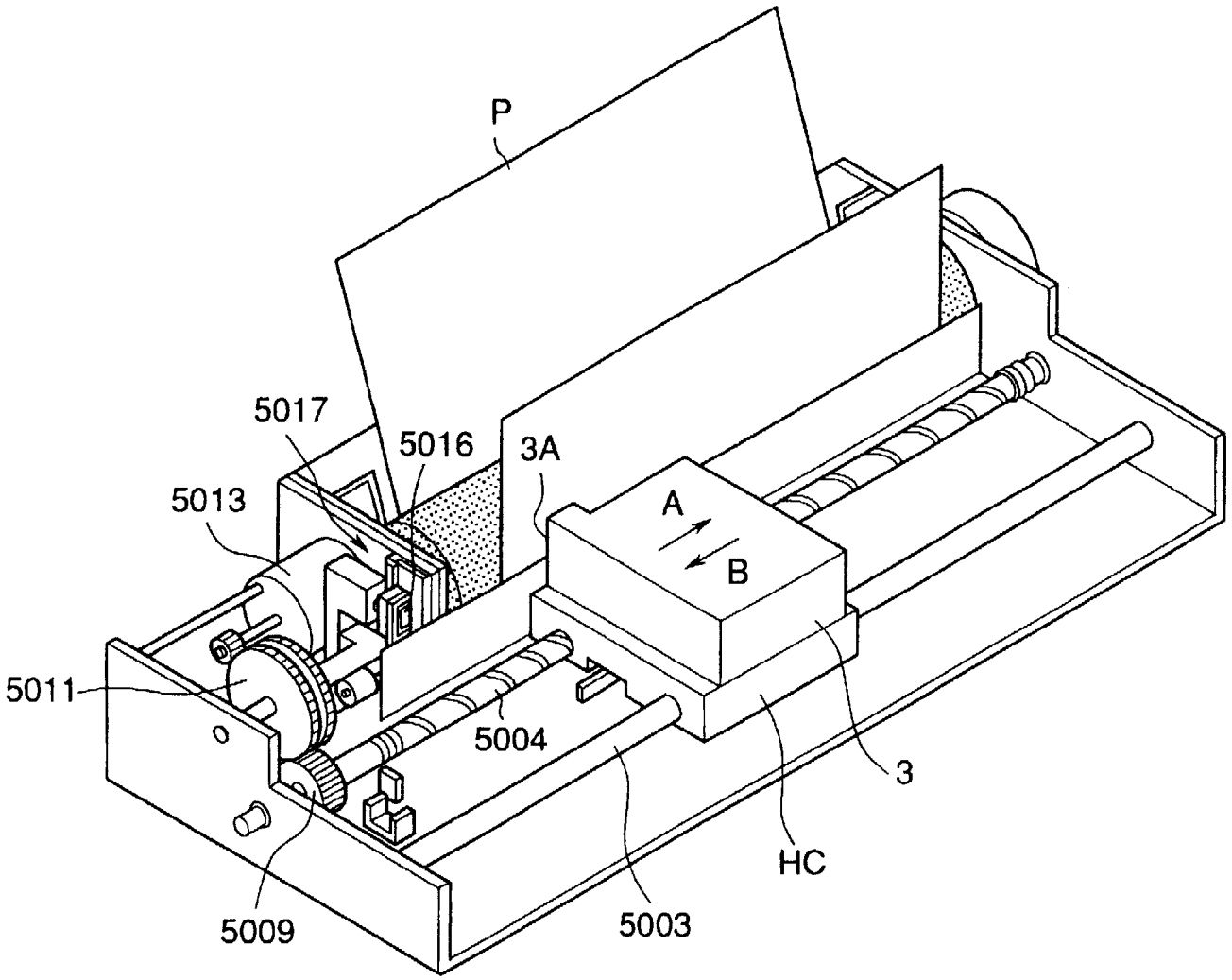
FIG. 5 is a perspective view which shows the structural example of an ink jet recording apparatus to which the present invention is applicable.
Figure 6:
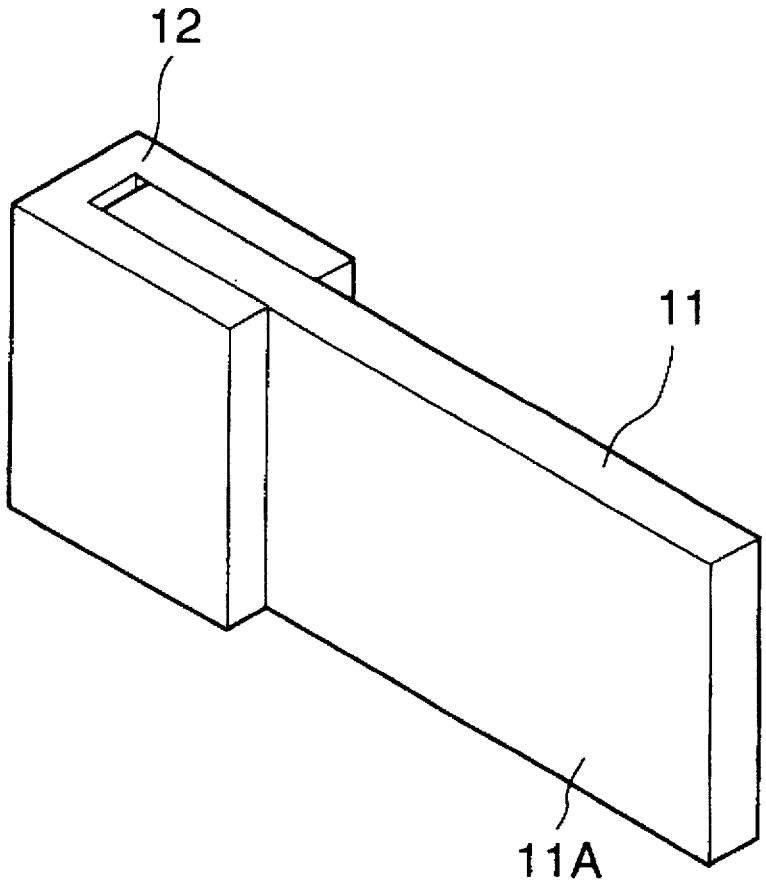
FIG. 6 is a perspective view which shows the structure of a wiping mechanism in accordance with a conventional example.
Figure 7:
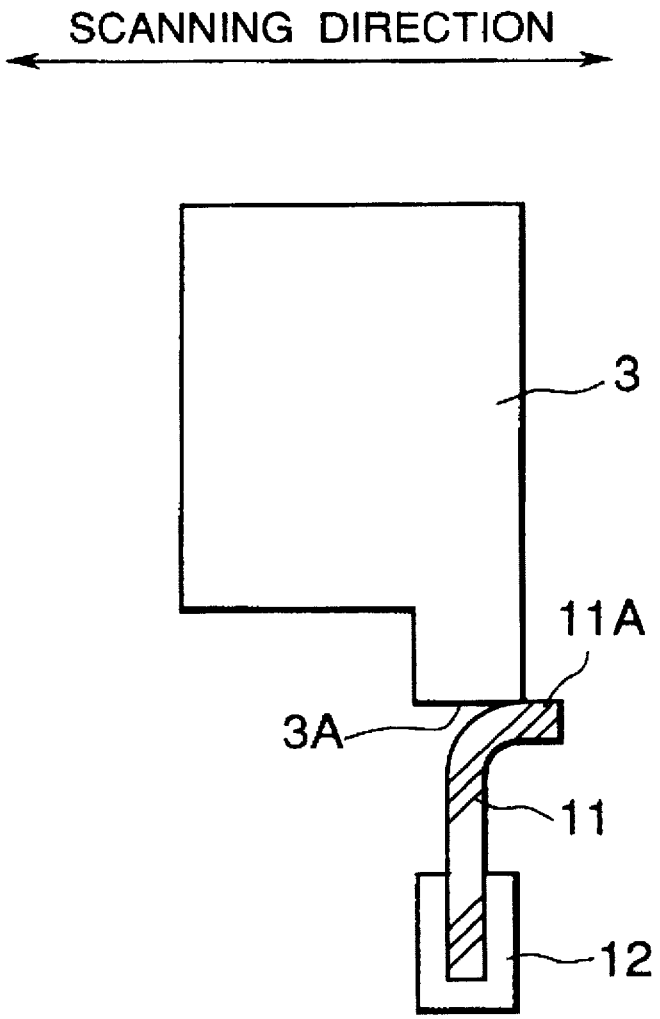
FIG. 7 is a view which illustrates the wiping operation by a wiping mechanism in accordance with a conventional example.

FIG. 5 shows one example of an ink jet recording apparatus in accordance with the present invention. This example represents an ink jet recording apparatus which performs recording in a mode that while the recording head 3 scans, ink is discharged to a recording material (recording sheet) P held substantially in the direction perpendicular to the ink discharge surface 3A. Here, a reference mark HC designates a head cartridge having the recording head 3 mounted on it, which travels along a guide shaft 5003. A reference numeral 5004 designates a lead screw having a part of the carriage HC screwed on it for driving the carriage HC; 5009, a driving gear to drive the lead screw 5004; and 5011, switching gears driven by means of a driving motor 5013 to drive the lead screw 5004 through the driving gear 5009, the gears being related to a series of recovery operations through switching means at the same time.

Also, reference numerals 5016 and 5017 designate a capping member and a wiping mechanism, respectively, which operate recovery with respect to the recording head 1 when the carriage HC is in the vicinity of the its home position. In this respect, the capping member 5016 and wiping mechanism 5017 are structured to travel individually toward the ink discharge surface 3A of the recording head 3 when operating a recovery. Here, the wiping mechanism 5017 comprises the blade 1 and the holder 2 formed as in the embodiments described above. In this example, a wiping operation is executed by the blade 1 when the recording head 3 travels in the direction A after a recovery is operated by discharging ink toward the capping member 5016 from the ink discharge surface 3A of the recording head 3 or by sucking ink therefrom.

As described above, in accordance with the present invention, a guide wall unit is arranged extendedly to the vicinity of the formation surface of ink discharge ports along the wiping surface of a blade in a wiping state of this blade, and then, ink adhering to the leading end of the wiping surface of the blade by the performance of a wiping is guided to the gap between the wide wall unit and the blade. Thus, by promoting capillary phenomenon and utilizing it, the ink, which is held on the leading end of the blade after wiping, can be induced immediately into an ink retainer arranged on the base portion of the blade. In this way, it is possible to prevent the residing ink on the leading end of the blade from being solidified and fixed thereto, and at the same time, suppress the flying splash of ink for the prevention of any stains on the recording material and circumference thereof. Further, in this way, it is possible to prevent the wiping function from being degraded.

What is claimed is:

1. A recovery mechanism provided with an elastic blade for wiping the formation surface of ink discharge ports of a recording head by allowing the leading end of the wiping surface to slide on said formation surface of ink discharge ports, comprising:

a guide wall unit extended to the vicinity of said formation surface of ink discharge ports along the wiping surface of said blade in a wiping state of said blade, ink adhering to the leading end of the wiping surface of said blade being guided to a gap between said guide wall unit and said blade.

2. A recovery mechanism according to claim 1, wherein a water repellent layer is arranged on a portion related at least to being slidably in contact on the surface along said guide wall unit and said blade.

3. A recovery mechanism according to claim 1, wherein fine grooves are arranged on the surface of said guide wall unit along said blade to guide the adhering ink by said wiping.

4. A recovery mechanism according to claim 1, wherein cut-off grooves are arranged on said blade at least along said guide wall unit to guide the adhering ink by said wiping.

5. A recovery mechanism according to claim 1, wherein ink guided to a gap between said guide unit and said blade is induced to an ink retainer arranged on a holder to hold the base of said blade.

6. A recovery mechanism according to claim 5, wherein said ink retainer is provided with an ink absorbent to absorb the guided ink.

7. An ink jet recording apparatus provided with an elastic blade for wiping the formation surface of ink discharge ports of the recording head by allowing the leading end of the wiping surface to slide on said formation surface of ink discharge ports, comprising:

a guide wall unit extended to the vicinity of said formation surface of ink discharge ports along the wiping surface of said blade in a wiping state of said blade, ink adhering to the leading end of the wiping surface of said blade being guided to a gap between said guide wall unit and said blade.

8. An ink jet recording apparatus according to claim 7, wherein a water repellent layer is arranged on a portion related at least to being in contact on the surface along said guide wall unit and said blade.

9. An ink jet recording apparatus according to claim 7, wherein fine grooves are arranged on the surface of said guide wall unit along said blade to guide the adhering ink by said wiping.

10. An ink jet recording apparatus according to claim 7, wherein cut-off grooves are arranged on said blade at least along said guide wall unit to guide the adhering ink by said wiping.

11. An ink jet recording apparatus according to claim 7, wherein ink guided to a gap between said guide unit and said blade is induced to an ink retainer arranged on a holder to hold the base of said blade.

12. An ink jet recording apparatus according to claim 11, wherein said ink retainer is provided with an ink absorbent to absorb the guided ink.

13. An ink jet recording apparatus according to claim 7, wherein said recording head is provided with means for generating energy for discharging ink from said ink discharge ports.

* * * * *